US008181735B2

(12) United States Patent
Canivenq

(10) Patent No.: US 8,181,735 B2
(45) Date of Patent: May 22, 2012

(54) AQUATIC LOUDSPEAKER HAVING A DIAPHRAGM

(76) Inventor: Noël Canivenq, Lamarque Pontacq (FR)

( * ) Notice: Subject to any disclaimer, the term of this patent is extended or adjusted under 35 U.S.C. 154(b) by 989 days.

(21) Appl. No.: 11/813,560

(22) PCT Filed: Jan. 10, 2006

(86) PCT No.: PCT/FR2006/000047

§ 371 (c)(1),
(2), (4) Date: May 7, 2008

(87) PCT Pub. No.: WO2006/075083

PCT Pub. Date: Jul. 20, 2006

(65) Prior Publication Data

US 2009/0003643 A1 Jan. 1, 2009

(30) Foreign Application Priority Data

Jan. 10, 2005 (FR) ..... 05 00227

(51) Int. Cl.
*H04R 1/04* (2006.01)

(52) U.S. Cl. ..... 181/149

(58) Field of Classification Search ..... 181/149, 181/165

See application file for complete search history.

(56) References Cited

U.S. PATENT DOCUMENTS

| | | | | | |
|---|---|---|---|---|---|
| 2,154,705 | A * | 4/1939 | Schultz | 381/392 |
| 4,456,797 | A * | 6/1984 | Olsen | 381/311 |
| 4,731,763 | A * | 3/1988 | Wagner | 367/153 |
| 4,949,806 | A * | 8/1990 | Hofer | 181/129 |
| 5,012,457 | A * | 4/1991 | Mitchell et al. | 367/175 |
| 5,142,508 | A * | 8/1992 | Mitchell et al. | 367/141 |
| 5,812,496 | A * | 9/1998 | Peck | 367/174 |
| 6,321,868 | B1 * | 11/2001 | Mignot et al. | 181/120 |
| 6,453,484 | B1 * | 9/2002 | Pinciaro | 4/541.6 |
| 6,545,948 | B1 * | 4/2003 | Jiang | 367/165 |
| 6,763,532 | B2 * | 7/2004 | Gardenier et al. | 4/541.1 |

FOREIGN PATENT DOCUMENTS

| | | |
|---|---|---|
| EP | 1063632 | 12/2000 |
| FR | 2633480 | 12/1989 |

OTHER PUBLICATIONS

English Translation of FR 2633480.*

* cited by examiner

*Primary Examiner* — Jeremy Luks
(74) *Attorney, Agent, or Firm* — Sturm & Fix LLP

(57) ABSTRACT

The invention relates to a submersible loudspeaker, comprised of a sound-diffusion element associated with a coil (3) consisting of an insulating support (4) and of an electrical coil (5) being connected to a peripheral magnet (6) in such a manner as to effect the transduction of an electric voltage to a musical frequency, characterized in that the sound-diffusion element is a diaphragm (2) consisting of a plastic circular planar wall of a predetermined thickness, and assigned to a bell-shaped bell (7), also made out of plastic.

18 Claims, 3 Drawing Sheets

AQUATIC LOUDSPEAKER HAVING A DIAPHRAGM

CROSS REFERENCE TO RELATED APPLICATIONS

This application claims priority of French application No. FR0500227 filed Jan. 10, 2005, which is incorporated by reference herein in its entirety.

BACKGROUND OF THE INVENTION

1. Field of the Invention

The present invention relates to a loudspeaker intended to be submerged in water in such a manner that it propagates sounds.

2. Description of the Related Art

Within this field of submersible loudspeakers it was already set forth to use quartz as sound-diffusion element.

Because of the imaginable waterproofing problems, the loudspeakers with diaphragm have always been ruled out for sound-diffusion in the water even though the quartz would present the advantage that it can be encased with an insulating plastic material, most certainly providing the sought waterproofing characteristics, but offering, on the other hand, a very poor quality of sound.

In fact, submersible quartz loudspeakers do not reproduce the frequency response below 400 Hz, that is to say the bass and low registers. Insofar as listening to music in the water is extremely sensitive, of psycho-sensory nature, it results that an inexact vibro-tactile signal is rejected and the reaction of anybody is that of coming out of the water.

This type of loudspeakers has already found an application in water sports, such as synchronized swimming; thus, with the aim of relaxing, it was imagined to transfer this technique to swimming pools, Jacuzzis and bathtubs but the whole problem continued and it was considered that the spoken words and quality music could not be diffused and understood under the water.

SUMMARY OF THE INVENTION

In accordance with a first stage of the inventive process, this disadvantage was overcome by deeming that the spoken words and quality music could be perfectly diffused and understood under the water, provided that a diaphragm is used.

It is known that conventional diaphragms, made out of tropicalized cardboard, certainly withstanding hygrometry but in no case submergible, can only be envisaged.

It is by wishing to overcome this second disadvantage that the invention was realized but the solution had to consist to offer, first and foremost, a high-fidelity acoustic quality, that is to say, reproducing frequency response of the musical frequency below 400 HZ, namely, the bass and low registers, and, secondly, a perfect watertightness.

To this effect, the invention relates to a submersible loudspeaker comprising a sound-diffusion element associated with a coil consisting of an insulating support and an electrical coil which is connected to a peripheral magnet in such a manner as to effect the transduction of an electric voltage to a musical frequency, characterized in that the sound-diffusion element is a diaphragm consisting of a plastic circular planar wall of a predetermined thickness, appropriate to produce the sound in association with the coil and to orient it thanks to a bell-shaped shell, also made out of plastic, connected, on the one hand, to the diaphragm at its lower, open peripheral edge and, on the other hand, to the magnet that is at least partially housed in a corresponding opening practiced on the back of the shell; these elements constitute an assembly forming between them a sealed internal chamber inside of which is situated the electrical coil in tight connection with the diaphragm and the magnet.

The present invention relates also to the characteristics that will be shown in the ensuing description which characteristics must be considered individually or according to all their possible technical combinations.

BRIEF DESCRIPTION OF THE DRAWINGS

This description, on hand of the hereto attached drawings, given by way of a non-limited example, will give a better understanding of the manner in which the invention can be realized, wherein.

DESCRIPTION OF THE PREFERRED EMBODIMENT

Figure 1:
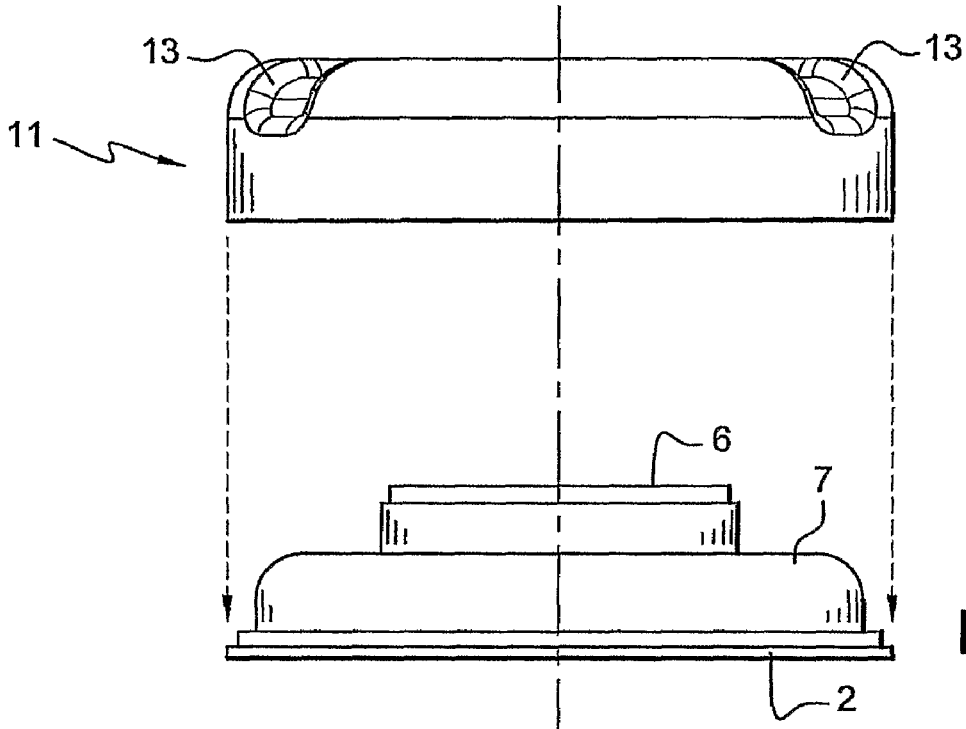
FIG. 1 shows an exploded side view of a loudspeaker assembly, namely, diaphragm-coil-shell-magnet and of an external sealing body, prior to being assembled, in accordance with a first embodiment.

A loudspeaker is usually constituted by a sound-diffusion element 2 that is connected to a coil 3 comprising an insulating support 4 and an electrical coil 5, connected to a peripheral magnet 6 in order to achieve the transduction of an electric voltage to a musical frequency.

In accordance with the invention, the sound-diffusion element 2 is a diaphragm 2 consisting of a plastic circular planar wall of a predetermined thickness, suitable to produce the sound in conjunction with the coil 3, and of a bell-shaped shell 7, also made out of plastic, connected, on the one hand, to the diaphragm 2 on its open lower peripheral edge 8 and, on the other hand, to the magnet 6 housed, at least partially, in a corresponding opening 9 practiced on the back 7*a* of the shell 7; these elements constitute an assembly forming between them a watertight internal chamber 10, inside of which is located the electric coil 3 in tight connection with the diaphragm 2 and the magnet 6.

Figure 4:
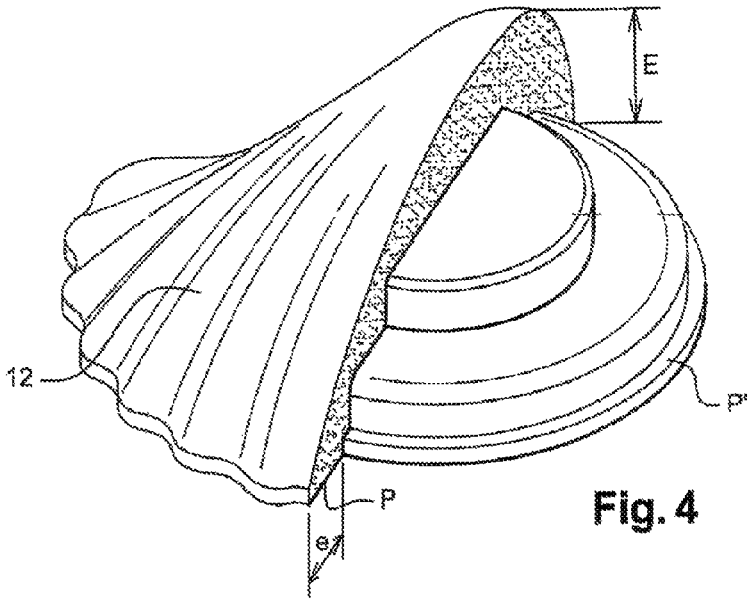
FIG. 4 shows a perspective view, partially cross-sectional, of a loudspeaker assembly in accordance with FIG. 3 with an external sealing body, in accordance with a second embodiment.

As clearly shown in FIG. 1 or 4, depending on the different embodiments, the waterproof assembly, constituted by the diaphragm 2, the shell 7 and the magnet 6, is provided on its back part 7*a,* opposite to the diaphragm 2, with a sealing body 11, 12, ensuring an additional watertightness and whose shape is such that it allows the obtaining of an optimal directivity of the sound.

Figure 2:
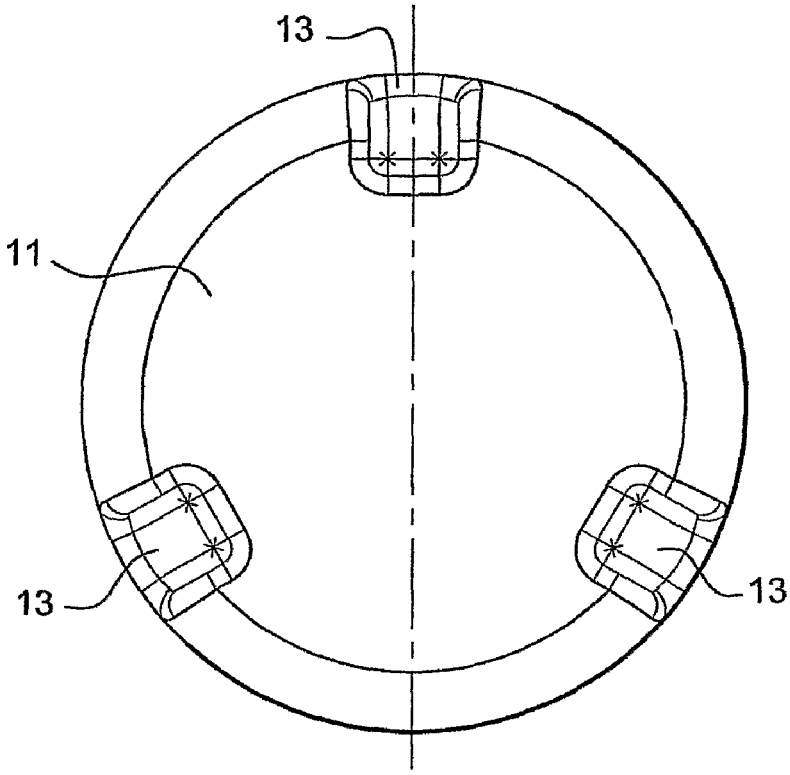
FIG. 2 shows a top view of a loudspeaker assembly and protective cover in accordance with FIG. 1, showing the fastening devices.

In more details, in accordance with the example of the embodiment of FIGS. 1 and 2, the sealing body 11 is obtained by a cylindrically or light bulb-shaped cast molding being provided with fastening devices 13, arranged in such a manner as to allow the securing of said loudspeaker instead of an underwater light projector, replacing its bulb.

Figure 5:
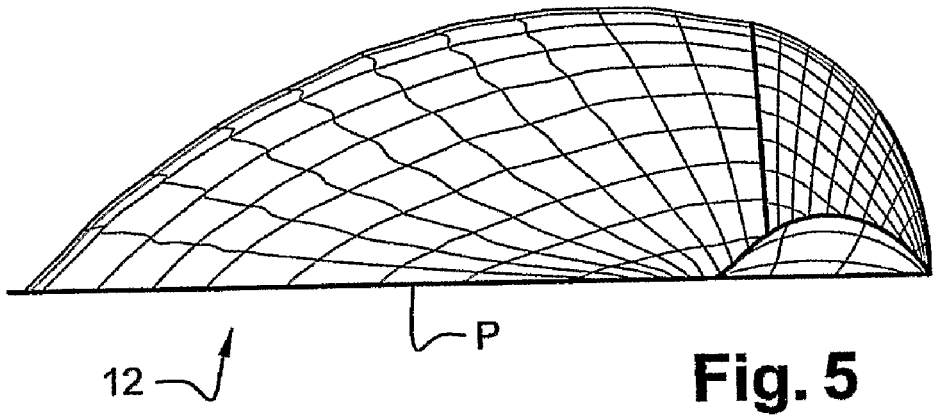
FIG. 5 shows a schematic side view of a loudspeaker equipped with a cover in accordance with the embodiment of FIG. 4.
Figure 6:
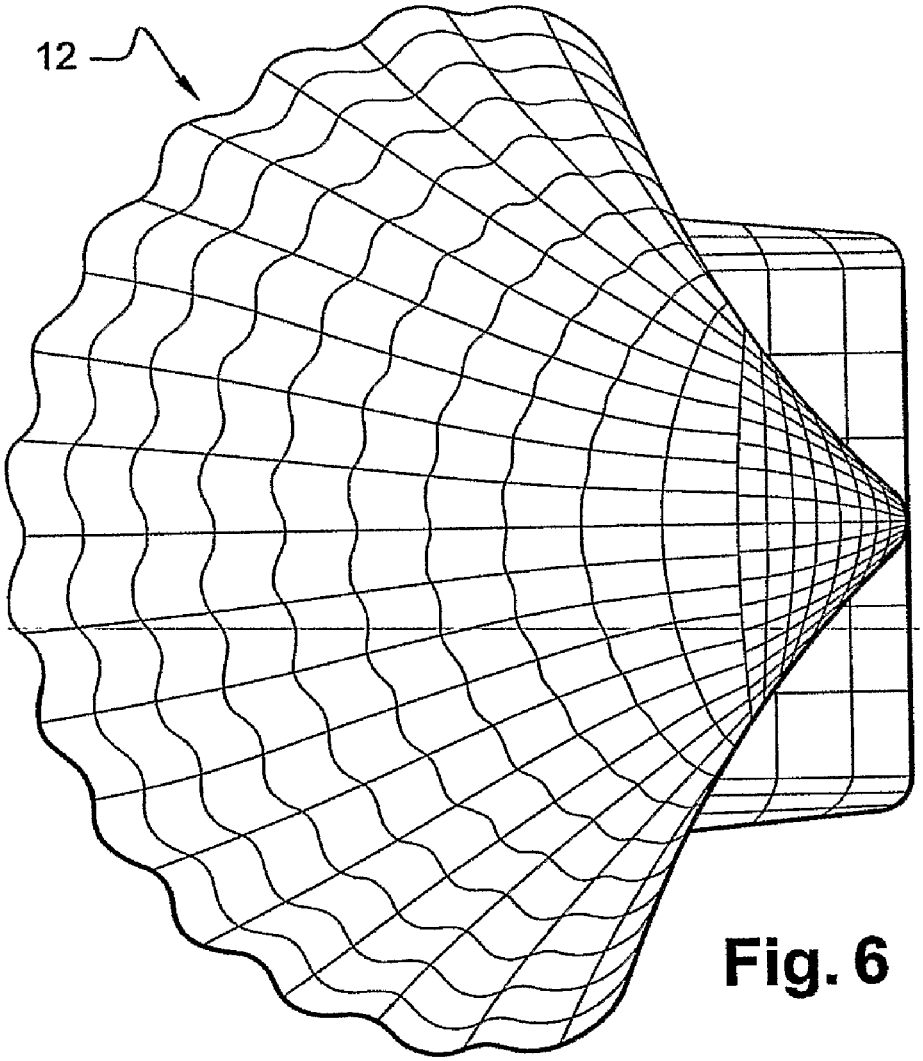
FIG. 6 shows a top view of a loudspeaker in accordance with FIG. 5.

In accordance with the second example of embodiment, shown in FIGS. 4, 5 and 6, the external sealing body 12 is obtained by a scallop shaped cast molding, presenting an opening plane P into which can be inserted the plane diaphragm 2, which permits a cast molding of variable thickness, thin e towards the front, relatively thicker E towards the rear, in such a manner as to obtain an optimum directivity of its sound.

Figure 3:
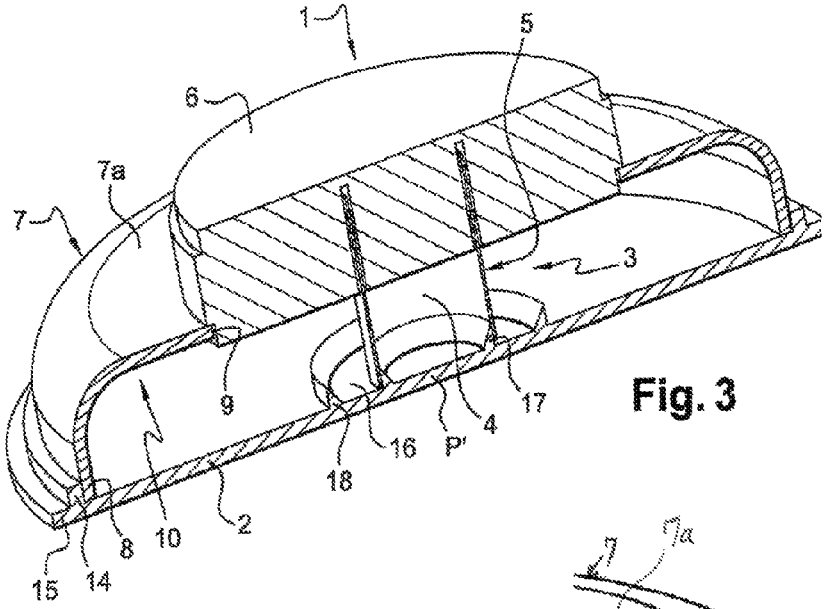
FIG. 3 shows a perspective view, and in a diametric section, of a loudspeaker assembly, namely, membrane-coil-shell-magnet.
Figure 3B:
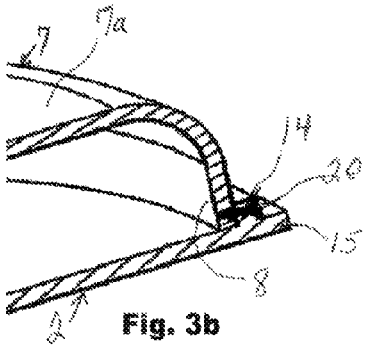
FIG. 3*b* shows a partial, perspective view, and in a diametric section, of a loudspeaker assembly, namely, membrane-coil-shell-magnet, illustrating the fastening configuration.

In accordance with another characteristic of the invention, in particular well visible from FIG. 3, the shell 7 is connected to the diaphragm 2 near their respective peripheral borders by means of an external peripheral lip 14 protruding from the diaphragm 2 and obtained together with it from the same casting process of a plastic material; said lip 14 forms a catch against the internal peripheral side wall which bears by interlocking the external side wall of its lower peripheral edge 8 of the shell 7.

Furthermore, the external fastening and the axial retaining of the diaphragm 2 with respect to the shell 7 are effectuated by means of a predetermined number of screws 20, that traverse in a radial direction the peripheral lip 14 of the diaphragm 2 and then the lower peripheral edge 8 of the shell 7.

In order to obtain the watertightness the diaphragm 2 presents on its plane P', beyond its peripheral lip 14, an also peripheral flange 15 intended to maintain the watertightness, from the moment of its application, of the lower peripheral area of the assembly, constituted by the lip 14, the base 8 of the shell 7 and the screws.

In accordance with yet another characteristic of the invention, the diaphragm 2 is provided on its internal side with a saucer-type area 16 delimited by two concentric lips of which the internal one 17 is intended for the housing, with a preset clamping, on its outside of the insulating support 4 of the coil 3; the other external [lip] 18, constituting with the first [lip] 17 the adhesive container 16 into which will be submerged the peripheral extremity of the support 4 of the coil 3 to which, prior to its interlocking, adhesive was also applied in order to obtain an inseparable bond with the diaphragm 2.

Tests have shown that excellent results were obtained with a plastic diaphragm 2 having a thickness of between 2 and 4 millimeters.

With respect to the utilized materials, the diaphragm 2 could be made out of a fiberglass reinforced polyurethane plastic while, by way of example, the shell 7 could be made out of filled polypropylene.

As regards the sealing body, it is made based on a silicone resin.

These different materials are not susceptible to chlorine water.

Figure 3A:
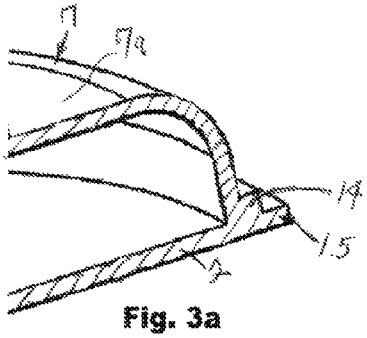
FIG. 3*a* shows a partial perspective view, and in a diametric section, of a loudspeaker assembly, namely, membrane-coil-shell-magnet, illustrating a single piece configuration of the diaphragm.

In accordance with an embodiment shown in FIG. 3*a*, the diaphragm 2 and the shell 7 consist of one single piece obtained from the same casting operation.

The invention claimed is:

1. A submersible loudspeaker of high-fidelity acoustic quality, comprising:

a sound-diffusion element, or diaphragm formed of a plastic circular planar wall;

a coil assembly including an insulating support and an electrical coil, the electrical coil being connected to a peripheral magnet to obtain the transduction of an electric voltage to a musical frequency;

a bell-shaped shell having an open lower peripheral edge and an opposing opening formed in a back portion of the shell, the shell being made of plastic, and being connected to the diaphragm at its open lower peripheral edge and, to the magnet at the opening formed in the back portion of the shell;

wherein the magnet, the diaphragm and the shell form a watertight internal chamber inter-connecting the diaphragm and the magnet.

2. A loudspeaker in accordance with claim 1, wherein the watertight chamber, constituted by the diaphragm, the shell and the magnet, is provided on its back portion opposite to the diaphragm, with a sealing body assembly, ensuring an additional watertightness, and whose shape is such that it allows the obtaining of an optimal directivity of the sound.

3. A loudspeaker in accordance with claim 2, wherein the external sealing body is a cylindrically or light bulb-shaped cast molding being provided with fastening devices, arranged in such a manner as to allow the securing of said loudspeaker.

4. A loudspeaker in accordance with claim 2, wherein the external sealing body is a scallop-shaped cast molding, presenting an opening plane into which can be inserted the diaphragm, which permits a cast molding of variable thickness, thin towards the front, relatively thicker towards the rear, in such a manner as to obtain an optimum directivity of its sound.

5. A loudspeaker in accordance with any of the claims 1 to 4, wherein the shell is connected to the diaphragm near their respective peripheral borders by means of an external peripheral lip protruding from the diaphragm, said lip forming a catch against an internal peripheral side wall which bears by interlocking an external side wall of its lower peripheral edge of the shell.

6. A loudspeaker in accordance with claim 5, wherein external fastening and axial retaining of the diaphragm with respect to the shell are effectuated by means of a predetermined number of screws, that traverse in a radial direction the peripheral lip of the diaphragm and then the lower peripheral edge of the shell.

7. A loudspeaker in accordance with claim 6, wherein the diaphragm presents a plane, beyond its peripheral lip forming a peripheral flange to maintain the watertightness, of the lower peripheral area of the loudspeaker.

8. A loudspeaker in accordance with any of the claims 1 to 4, wherein the diaphragm is provided on an internal side with a saucer-type area delimited by two concentric lips of which an internal lip is intended to engage the insulating support of the coil, while an external lip constitutes with the internal lip an adhesive container into which will be submerged the peripheral extremity of the support of the coil to which, prior to its interlocking, adhesive was also applied in order to obtain an inseparable bond with the diaphragm.

9. A loudspeaker in accordance with any of the claims 1 to 4, wherein the plastic diaphragm has a thickness of between 2 and 4 millimeters.

10. A loudspeaker in accordance with either of the claims 1 or 2, wherein the diaphragm and the shell consist of one single piece obtained from the same casting operation.

11. A loudspeaker in accordance with claim 5, wherein the diaphragm is provided on an internal side with a saucer-type area delimited by two concentric lips of which an internal lip is intended to engage the insulating support of the coil, while an external lip constitutes with the internal lip an adhesive container into which will be submerged the peripheral extremity of the support of the coil to which, prior to its interlocking, adhesive was also applied in order to obtain an inseparable bond with the diaphragm.

12. A loudspeaker in accordance with claim 6, wherein the diaphragm is provided on an internal side with a saucer-type area delimited by two concentric lips of which an internal lip is intended to engage the insulating support of the coil, while an external lip constitutes with the internal lip an adhesive container into which will be submerged the peripheral extremity of the support of the coil to which, prior to its interlocking, adhesive was also applied in order to obtain an inseparable bond with the diaphragm.

13. A loudspeaker in accordance with claim 7, wherein the diaphragm is provided on an internal side with a saucer-type area delimited by two concentric lips of which an internal lip is intended to engage the insulating support of the coil, while an external lip constitutes with the internal lip an adhesive container into which will be submerged the peripheral extremity of the support of the coil to which, prior to its interlocking, adhesive was also applied in order to obtain an inseparable bond with the diaphragm.

14. A loudspeaker in accordance with claim 5, wherein the plastic diaphragm has a thickness of between 2 and 4 millimeters.

15. A loudspeaker in accordance with claim 6, wherein the plastic diaphragm has a thickness of between 2 and 4 millimeters.

16. A loudspeaker in accordance with claim 7, wherein the plastic diaphragm has a thickness of between 2 and 4 millimeters.

17. A loudspeaker in accordance with claim 8, wherein the plastic diaphragm has a thickness of between 2 and 4 millimeters.

18. A submersible loudspeaker, comprising:

a sound-diffusion element, or diaphragm formed of a plastic circular planar wall;

a coil assembly including an insulating support and an electrical coil, the electrical coil being connected to a peripheral magnet to obtain the transduction of an electric voltage to a musical frequency;

a bell-shaped shell having an open lower peripheral edge and an opposing opening formed in a back portion of the shell, the shell being made of plastic, and being connected to the diaphragm at its open lower peripheral edge and to the magnet at the opening formed in the back portion of the shell;

wherein the magnet, the diaphragm and the shell form a watertight internal chamber inter-connecting the diaphragm and the magnet; and wherein the diaphragm is provided on an internal side with a saucer-type area delimited by two concentric lips of which an internal lip is intended to engage the insulating support of the coil, while an external lip constitutes with the internal lip an adhesive container into which will be submerged the peripheral extremity of the support of the coil to which, prior to its interlocking, adhesive was also applied in order to obtain an inseparable bond with the diaphragm.

* * * * *